US010765230B2

(12) United States Patent
Jeneske

(10) Patent No.: US 10,765,230 B2
(45) Date of Patent: Sep. 8, 2020

(54) BABY CARRIER AND METHODS OF USE THEREOF

(71) Applicant: Jessica Jeneske, Lincoln, NE (US)

(72) Inventor: Jessica Jeneske, Lincoln, NE (US)

(73) Assignee: LITTLE BUG CREATIONS, LLC, Lincoln, NE (US)

( * ) Notice: Subject to any disclaimer, the term of this patent is extended or adjusted under 35 U.S.C. 154(b) by 0 days.

(21) Appl. No.: 16/362,384

(22) Filed: Mar. 22, 2019

(65) Prior Publication Data

US 2019/0290018 A1 Sep. 26, 2019

Related U.S. Application Data

(60) Provisional application No. 62/754,222, filed on Nov. 1, 2018, provisional application No. 62/646,603, filed on Mar. 22, 2018.

(51) Int. Cl.
*A47D 13/02* (2006.01)

(52) U.S. Cl.
CPC ..... *A47D 13/025* (2013.01)

(58) Field of Classification Search
CPC ..... A47D 13/025; A47D 13/02; A61G 1/00; Y10T 29/49826
See application file for complete search history.

(56) References Cited

U.S. PATENT DOCUMENTS

| | | | | |
|---|---|---|---|---|
| 4,166,558 | A * | 9/1979 | Schroeder | A47D 13/025 224/158 |
| 5,071,047 | A * | 12/1991 | Cordisco | A47D 13/025 224/158 |
| 7,284,503 | B2 * | 10/2007 | Elmberg | A47D 13/025 119/770 |
| D614,861 | S | 5/2010 | Smyth et al. | |
| D672,546 | S | 12/2012 | Dror et al. | |
| D691,791 | S | 10/2013 | Rondone | |
| 8,925,772 | B2 | 1/2015 | Vukovics | |
| D738,615 | S | 9/2015 | Chapman | |
| 9,198,525 | B2 | 12/2015 | Wernick et al. | |
| 9,380,886 | B2 | 7/2016 | Rahni | |
| D844,973 | S * | 4/2019 | Gibbons | D3/214 |
| 10,264,894 | B2 * | 4/2019 | Gibbons | A47D 13/025 |
| 2005/0133551 | A1 | 6/2005 | Heidt | |
| 2007/0278264 | A1 | 12/2007 | Chesal et al. | |
| 2011/0240693 | A1 * | 10/2011 | Parness | A47D 13/025 224/160 |
| 2012/0152987 | A1 * | 6/2012 | Beltrame | A47D 13/025 224/158 |
| 2012/0199619 | A1 | 8/2012 | Zack | |
| 2012/0286002 | A1 | 11/2012 | Dardel et al. | |
| 2014/0231472 | A1 * | 8/2014 | Cha | A47D 13/025 224/160 |
| 2014/0231473 | A1 | 8/2014 | Bailey et al. | |

* cited by examiner

*Primary Examiner* — Brian D Nash
(74) *Attorney, Agent, or Firm* — Polsinelli PC

(57) ABSTRACT

Disclosed is an adjustable and easy to use baby carrier that provides the same benefits of a traditional style baby carrier.

18 Claims, 4 Drawing Sheets

BABY CARRIER AND METHODS OF USE THEREOF

CROSS REFERENCE TO RELATED APPLICATIONS

This application claims priority to U.S. Provisional Application No. 62/646,603 filed Mar. 22, 2018, and U.S. Provisional Application No. 62/754,222 filed Nov. 1, 2018, both of which are incorporated herein in their entireties.

FIELD OF THE INVENTION

The present invention relates generally to a baby carrier. More specifically, the present invention is a cross between a wrap carrier and a traditional back-pack style carrier.

BACKGROUND OF THE INVENTION

Traditional style baby wraps allow a person to "wear" a baby close to the body thereby providing numerous benefits. Babies who are worn often cry less, which makes parenting easier, promotes attachment, and encourages healthy mental and emotional development. Traditional style baby wrap carriers are a long length of fabric that is wrapped around the wearer's body, creating enough passes of fabric for a baby to safely be carried without the caregiver having to hold the baby with their arms. However, a wearer will need to learn how to use the wrap, which requires a significant amount of practice. In fact, many caregivers give up because it is too confusing. Further, baby wraps cannot be easily adjusted to fit the baby and/or the wearer.

Therefore, there is a need for a baby carrier that would provide all the benefits of a traditional style baby wrap carrier, but further provide ease of use and adjustability.

SUMMARY

In an aspect, the present disclosure encompasses a baby carrier for carrying a baby by a wearer. In an aspect, the carrier may include a back panel, a first length of fabric secured to the back panel and extending from the back panel, and a second length of fabric secured to the back panel and extending from the back panel. The back panel may include a top side having a first top end and a second top end and a bottom side having a first bottom end comprising a first means for securing a length of fabric to the first bottom end, and a second bottom end comprising a second means for securing a length of fabric to the second bottom end. In an aspect, the first length of fabric removably engages the second means for removably securing a length of fabric, and the first length of fabric removably engages the first means for removably securing a length of fabric. In another aspect, the second length of fabric crosses over the first length of fabric thereby defining a pouch for carrying a baby.

The present disclosure further encompasses a method of carrying a baby by a wearer. In an aspect, the method may include providing a baby carrier, contacting the back panel of the baby carrier with the back of the wearer, draping the lengths of fabric over the wearer's shoulders, crossing the lengths of fabric in front of the wearer, engaging the first length of fabric with the second means for removably securing a length of fabric, engaging the second length of fabric with the first means for removably securing a length of fabric, securing the lengths of fabric to each other on the front side of the wearer, and inserting the baby into the pouch defined by crossing the first and second length of fabric.

Other aspects and iterations of the invention are described more thoroughly below.

DETAILED DESCRIPTION

Disclosed herein is a baby carrier that provides the same benefits of a traditional style baby carrier, but is further adjustable and easy to use.

I. Baby Carrier

Figure 1:
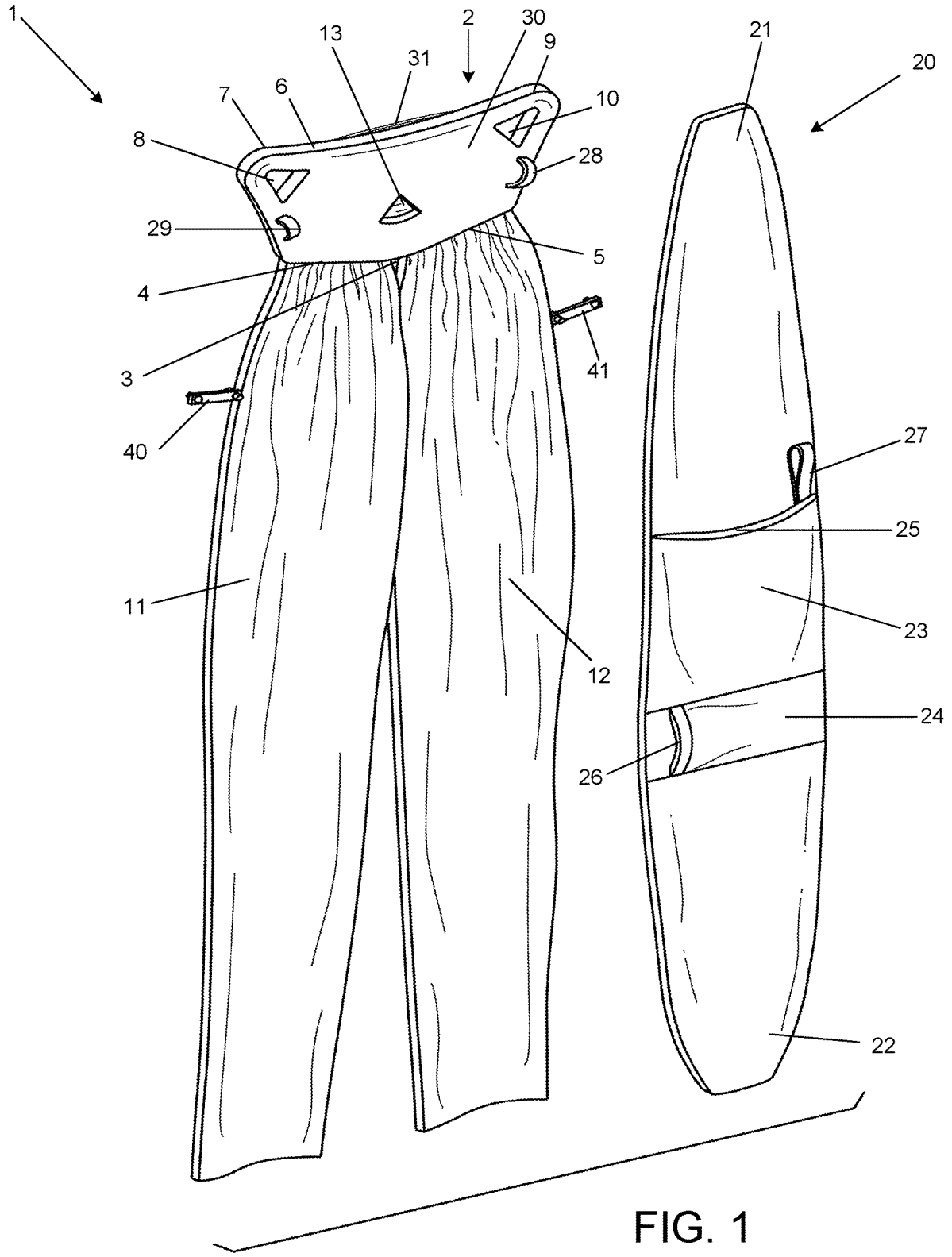
FIG. 1 is a perspective view of an embodiment of the baby carrier and a sash.
Figure 2:
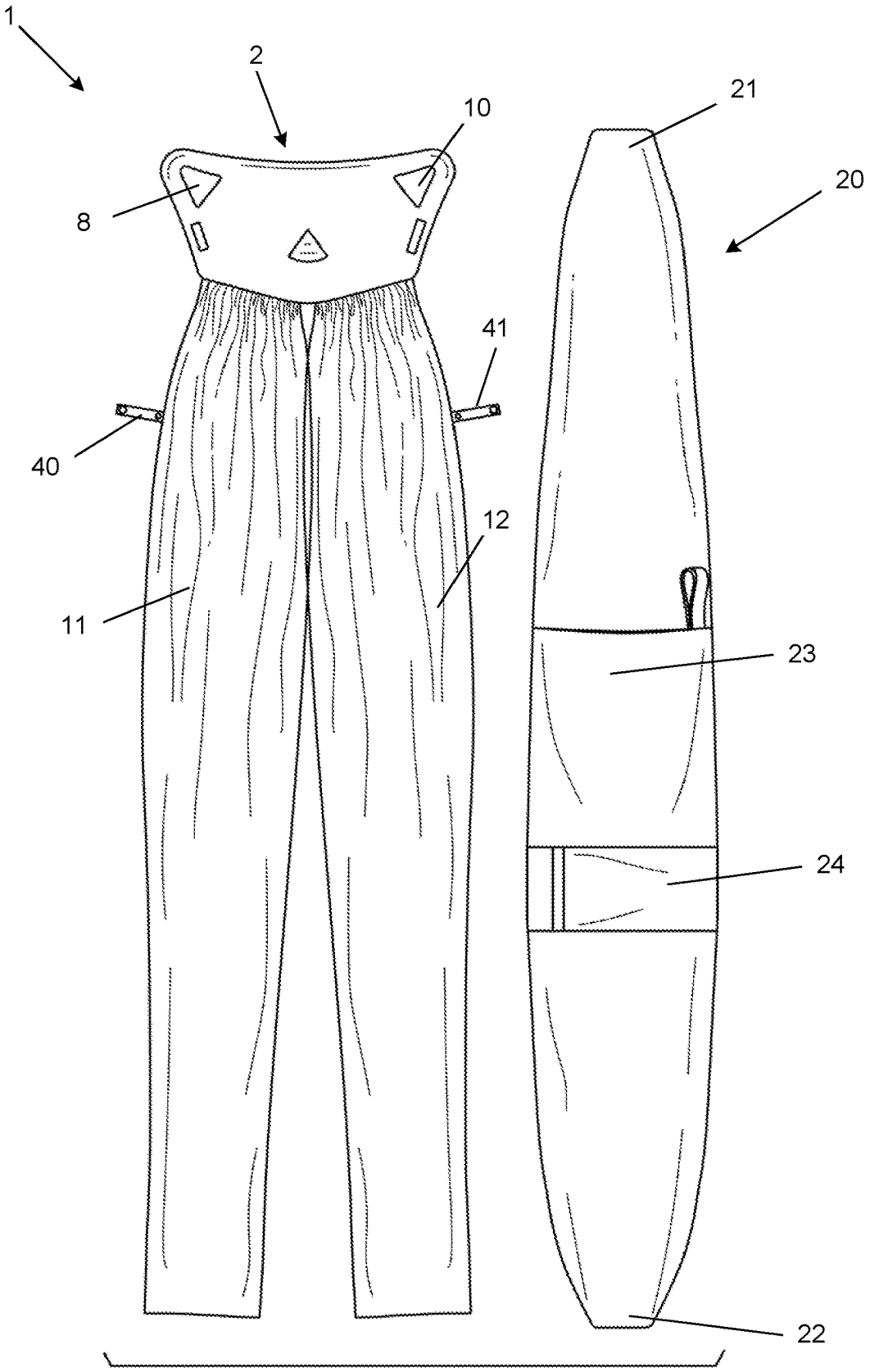
FIG. 2 is a front view of an embodiment of the baby carrier and a sash.
Figure 3:
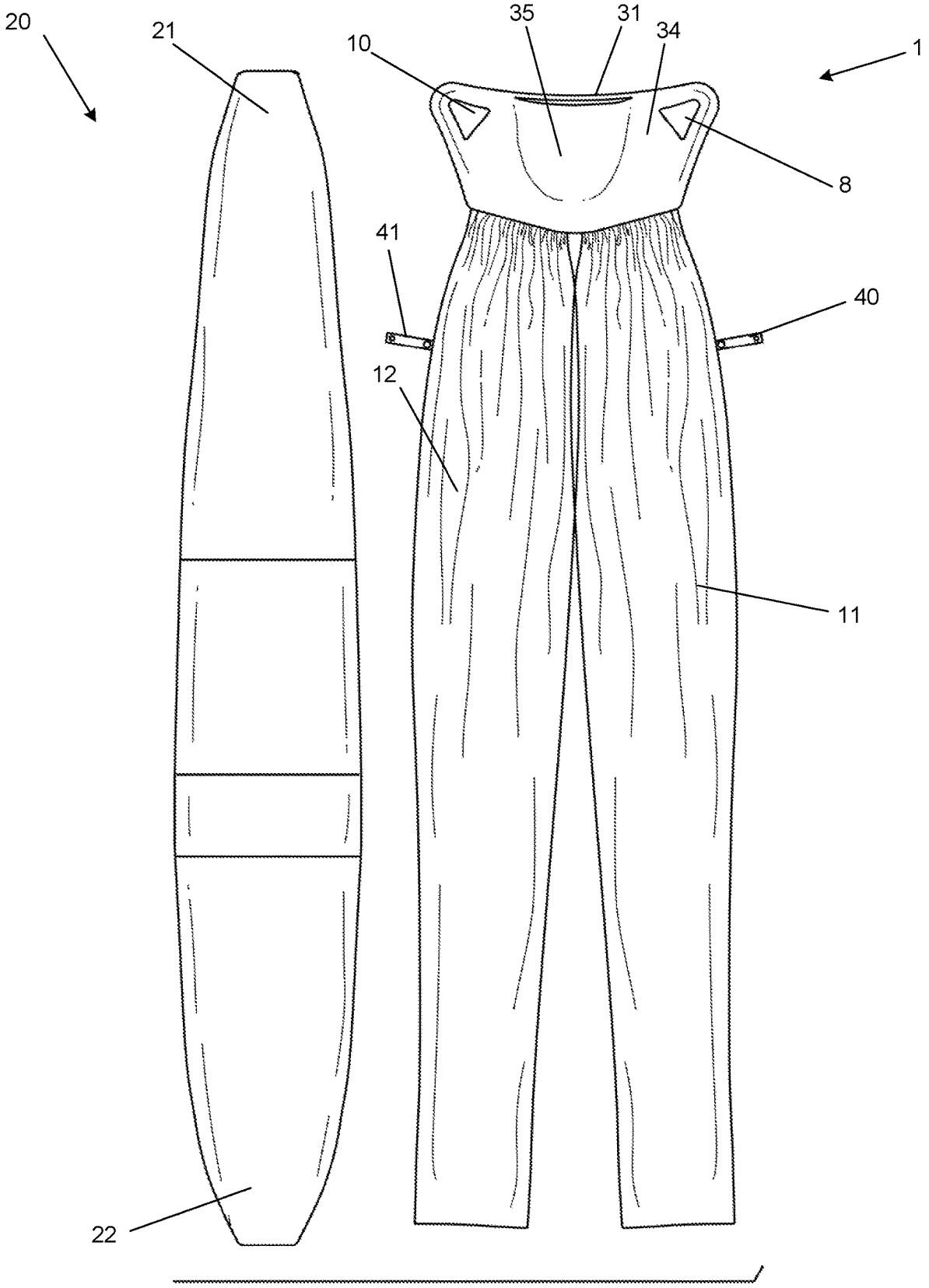
FIG. 3 is a back view of an embodiment of the baby carrier and a sash.

One aspect of the present disclosure comprises a baby carrier 1 for wearing a baby close to a wearer's body. Referring to FIGS. 1-3, shown is the baby carrier 1 with a back panel 2. The back panel 2 may include a front side 34 and a back side 30. Additionally, the back panel 2 may include a top side 3 having a first top end 4 and a second top end 5. The back panel further may include a bottom side 6 having a first bottom end 7 having a first means 8 for removably securing a length of fabric to the first bottom end 7, and a second bottom end 9 having a second means 10 for removably securing a length of fabric to the second bottom end 9.

The baby carrier further includes a first length of fabric 11 secured to the first top end 4 of the back panel 2 and extending from the first top end 4 of the back panel, and a second length of fabric 12 secured to the second top end 5 of the back panel and extending from the second top end 5 of the back panel. The first length of fabric 11 removably engages the second means 10 for removably securing a length of fabric, and the second length of fabric 12 removably engages the first means 8 for removably securing a length of fabric. The second length of fabric 12 crosses over the first length of fabric 11 thereby defining a pouch 50 (shown in FIG. 4) for carrying a baby.

Each component of the baby carrier may be independently made from any material that may be suitable for a baby carrier. For instance, the baby carrier may be made from a knit blend, cotton, artificial fabric, and combinations thereof. Preferably the baby carrier is made from a stretchy material for providing safety and support for the baby and comfort for the wearer.

In an embodiment, the lengths of fabric are removably secured to the top ends of the back panel. In another embodiment, the lengths of fabric are fixedly secured to the top ends of the back panel. The lengths of fabric may be fashioned from the same piece of material as the back panel. Alternatively, the lengths of fabric may be stitched to the top ends of the back panel.

Figure 4:
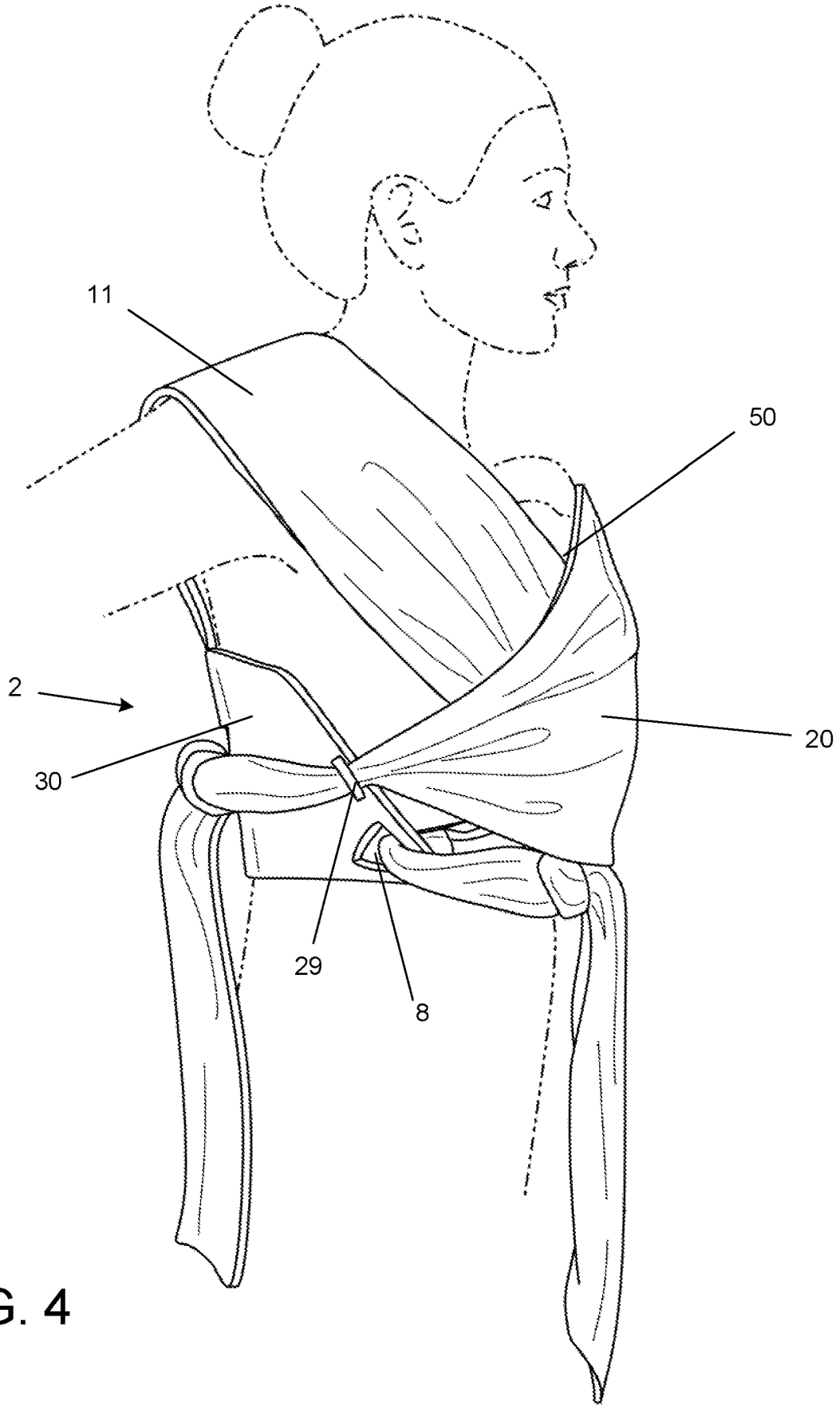
FIG. 4 is a perspective view of an embodiment of the baby carrier worn by a wearer. In this embodiment, a sash is worn around the wearer.

The means for removably securing the lengths of fabric 11 and 12 to the back panel 2 may be any means suitable for a baby carrier of the disclosure. Preferably, the means for securing are slits or openings in the bottom ends of the back panel for threading the lengths of fabric through the slits as shown in FIG. 4, thereby securing the lengths of fabric. The slits or openings in the bottom ends of the back panel may be of any shape sufficient to receive the lengths of fabric. For example, the slits or openings may be triangular, circular, oval, square, or rectangular. The diameter of the slits or openings may range from about 1.5 inches to about 2.75 inches in at least one direction.

The dimensions of the lengths of fabric may be any length and width suitable for a baby carrier of the disclosure. The lengths of fabric are sufficiently long to wrap around the baby and the wearer, engage the securing means, and securing the lengths of fabric to each other. For instance, the lengths of fabric may range from about 30 to about 100 inches in length, preferably from about 50 to about 70 inches in length. Further, the lengths of fabric are sufficiently wide to provide a safe and comfortable pouch for the baby, and comfort for the wearer. The lengths of fabric may range from about 10 to about 80 inches in length, preferably from about 20 to about 50 inches in length.

In some embodiments, the lengths of fabric may further include one or more means for collecting loose fabric 40, 41 to keep the lengths of fabric away from a baby being carried in the carrier. For instance, a means for collecting loose fabric may be attached to a length of fabric at a location that, when worn, the means for collecting the loose fabric may be adjacent to the face of a baby being carried, thereby keeping the fabric of the carrier. The means for collecting may be a clip, a snap, Velcro, a strap, a ribbon, a string or any other means capable of collecting fabric of the sash. In an example, the means for collecting may be a strap with a snap at the end, such that the strap may be wrapped around the length of fabric and snapped secure.

The back panel 2 may be any shape and size, provided the back panel 2 provides sufficient functionality for accommodating the lengths of fabric on the top ends, and means for securing the lengths of fabric at the bottom ends. For instance, the top of the back panel may form an oval shaped collar or may form a V shape. Further, the back panel 2 may be breathable to provide comfort for the wearer. For instance, the back panel may be ventilated. In one embodiment, the back panel 2 comprises an opening 13 for ventilation. Preferably, the back panel comprises a mesh opening for ventilation.

In some embodiments, the back panel may further comprise a pocket 35, as shown in FIG. 3. The pocket may be on the back side 30 or on the front side 34 of the back panel 2. An opening 31 of the pocket may be on any side of the back panel. For instance, the opening 31 may be on the bottom side 6 of the back panel 2 as shown in FIGS. 1-3. The pocket 35 may be sufficiently large to store the baby carrier 1 by inverting the pocket into itself, and gathering and packaging the baby carrier in the pocket. The pocket may be formed by attaching fabric material to the front side of the back panel 2. In some embodiments, the pocket 35 is the same size and shape as the back panel 2.

The baby carrier may further comprise a sash 20 having a first end 21 and a second end 22. The sash 20 is configured to horizontally wrap around the baby and the wearer for securing the carrier to the wearer. As shown in FIG. 4, the sash 20 may be secured around the baby and the wearer by securing the first end 21 and second end 22 of the sash around the back of the wearer, e.g., by knotting the sash ends around the wearer and the baby behind the wearer's back. The sash ends may be inserted through elastic loops 28 and 29 to secure the sash 20 to the back 30 of the baby carrier (FIG. 4)

The dimensions of the sash 20 may be any length and width suitable for a baby carrier of the disclosure. The sash is sufficiently long to wrap around the baby and the wearer and to secure the sash around the wearer and the baby. For instance, the sash may range from about 30 to about 150 inches in length, preferably from about 50 to about 80 inches in length. Further, the sash is sufficiently wide to provide sufficient support and safety for the baby, and have sufficient room for one or more pockets as described below. The width of the sash may range from about 12 to about 18 inches in width, preferably from about 13 to about 14.5 inches in width.

In some embodiments the sash 20 further includes a first pocket 23 and a second pocket 24. The first pocket 23 may be sufficiently large to store the baby carrier by gathering and packaging the baby carrier in the pocket. In an embodiment, an opening 25 of the first pocket 23 may be vertical such that it is perpendicular to the length of the sash 20. In some embodiments, the vertical first opening 25 may extend the full width of the sash. The first pocket 23 may range in size from about 12 inches to about 14 inches in length by about 12 inches to about 16 inches in width. In an embodiment, the first pocket 23 may be square. For example, the first pocket may be about 14 inches by about 14 inches. The second pocket 24 may be sufficiently large to store supplies for the baby. For instance, the second pocket 24 may be sufficiently large to store a pacifier and/or a baby toy. An opening 26 of the second pocket 24 may be horizontal such that it is parallel to the length of the sash 20. The second pocket 24 may range in size from about 13 inches to about 14.5 inches in length by about 3 inches to about 5 inches in width.

The first pocket 23 may have a first loop 27 attached on one side of the opening 25. In an embodiment, the first loop 27 may be attached at the bottom of the vertical opening 25 of the first pocket 23. The first loop 27 may be used to secure any extra length of material that hangs down from the carrier and/or the sash after wearing the baby carrier and the sash. The second pocket may further comprise a second loop (not shown) attached on one side of the opening 26. The second loop may be used to attach baby supplies for secure storage.

When the baby carrier 1 includes a sash 20, the back panel 2 of the baby carrier 1 may further include at least one means for attaching the sash to the baby carrier. In one embodiment, a means for attaching is a means for fixedly attaching the sash to the back panel of the baby carrier. For instance, the at least one means for attaching the sash to the baby carrier may be by stitching the sash to the back of the baby carrier. In another embodiment, a means for attaching may be a means for removably attaching the sash to the back panel of the baby carrier. For instance, the at least one means for attaching may be an elastic loop 28 and 29 configured to removably secure the sash to the back of the baby carrier (FIG. 4).

Preferred embodiments of a baby carrier may be as depicted in the figures.

II. Method of Using the Baby Carrier

Another aspect of the present disclosure comprises a method of carrying a baby by a wearer using a baby carrier. The method comprises providing a baby carrier of the disclosure. The wearer contacts the back panel of the carrier with his/her back, and drapes the lengths of fabric over his/her shoulders. The wearer then crosses the lengths of fabric at the front of the chest, and secures each length of fabric to the back panel by engaging the lengths of fabric with the means for securing the lengths of fabric on the back panel. The wearer then secures the lengths of fabric to each other at the front of the wearer. The crossing of the lengths of fabric in front of the wearer defines a pouch where the baby can be inserted. The wearer may further wrap and tie a sash around the baby and the wearer.

In an embodiment, the method of carrying a baby by a wearer comprises providing a baby carrier as described herein; contacting the back panel with the back of the wearer; draping the lengths of fabric over the wearer's shoulders; crossing the lengths of fabric in front of the wearer; engaging the first length of fabric with the second means for removably securing a length of fabric; engaging the second length of fabric with the first means for removably securing a length of fabric; securing the lengths of fabric to each other on the front side of the wearer; and inserting the baby into the pouch defined by crossing the first and second length of fabric. The method may further comprise wrapping the sash around the baby and the wearer and fastening the sash around the baby and the wearer.

The invention claimed is:

1. A baby carrier for carrying a baby by a wearer, the carrier comprising:

a. a back panel comprising:

i. a top side having a first top end and a second top end; and ii. a bottom side having a first bottom end comprising a first means for removably securing a length of fabric to the first bottom end, and a second bottom end comprising a second means for removably securing a length of fabric to the second bottom end;

b. a first length of fabric secured to the first top end of the back panel and extending from the first top end of the back panel;

c. a second length of fabric secured to the second top end of the back panel and extending from the second top end of the back panel; and d. a sash comprising a first end, a second end, and at least one pocket, wherein the first length of fabric removably engages the second means for removably securing a length of fabric, and the first length of fabric removably engages the first means for removably securing a length of fabric, wherein the second length of fabric crosses over the first length of fabric thereby defining a pouch for carrying a baby, and wherein the sash is configured to horizontally wrap around the baby and the wearer.

2. The carrier of claim 1, wherein the lengths of fabric are removably secured to the top ends of the back panel.

3. The carrier of claim 1, wherein the lengths of fabric are fixedly secured to the top ends of the back panel.

4. The carrier of claim 1, wherein the back panel is stretchable.

5. The carrier of claim 1, wherein the back panel further comprises an opening for ventilation.

6. The carrier of claim 5, wherein the opening is a mesh opening.

7. The carrier of claim 1, wherein the sash is secured around the baby and the wearer by knotting the first and second ends of the sash.

8. The carrier of claim 1, wherein the at least one pocket is on a face of the sash facing the baby.

9. The carrier of claim 1, wherein the sash comprises a first and a second pocket.

10. The carrier of claim 9, wherein the first pocket is sufficiently large to store the baby carrier.

11. The carrier of claim 9, wherein an opening of the first pocket is vertical.

12. The carrier of claim 9, wherein the second pocket is sufficiently large to store supplies for the baby.

13. The carrier of claim 9, wherein an opening of the second pocket is horizontal.

14. The carrier of claim 9, wherein the second pocket further comprises a loop attached on one side of the opening.

15. The carrier of claim 9, wherein the first pocket further comprises a second loop attached on one side of the opening.

16. The carrier of claim 1, wherein the back panel further comprises at least one means for attaching the sash to the back panel.

17. The carrier of claim 16, wherein the at least one means for attaching is an elastic loop configured to removably secure the sash to the back of the baby carrier.

18. The carrier of claim 16, wherein the at least one means for attaching is stitching the sash to the back of the baby carrier.

* * * * *